US009578948B2

(12) United States Patent
Raouf et al.

(10) Patent No.: US 9,578,948 B2
(45) Date of Patent: Feb. 28, 2017

(54) PRINTABLE NAIL STRIPS

(71) Applicant: Avon Products, Inc., Suffern, NY (US)

(72) Inventors: Maha Raouf, Franklin Lakes, NJ (US); Jeanine Weigman-Smith, Andover, NJ (US)

(73) Assignee: AVON PRODUCTS, INC., Rye, NY (US)

( * ) Notice: Subject to any disclaimer, the term of this patent is extended or adjusted under 35 U.S.C. 154(b) by 0 days.

(21) Appl. No.: 14/337,515

(22) Filed: Jul. 22, 2014

(65) Prior Publication Data

US 2015/0173483 A1 Jun. 25, 2015

Related U.S. Application Data

(60) Provisional application No. 61/919,271, filed on Dec. 20, 2013.

(51) Int. Cl.
*A45D 29/00* (2006.01)

(52) U.S. Cl.
CPC ..... *A45D 29/001* (2013.01); *A45D 2029/005* (2013.01)

(58) Field of Classification Search
CPC . A45D 29/001; A45D 31/00; A45D 2029/005
USPC ..... 347/16, 180–182
See application file for complete search history.

(56) References Cited

U.S. PATENT DOCUMENTS

| | | | | |
|---|---|---|---|---|
| 5,110,584 | A * | 5/1992 | Medri | A61K 8/02 106/31.02 |
| 5,901,714 | A * | 5/1999 | Benkart | A45D 29/004 132/285 |
| 6,065,969 | A * | 5/2000 | Rifkin | A45D 29/001 434/100 |
| 6,264,786 | B1 | 7/2001 | Cromett | |
| 7,037,564 | B1 | 5/2006 | Abron | |
| 8,586,164 | B2 | 11/2013 | Weber et al. | |
| 8,857,943 | B2 * | 10/2014 | Raming | B41J 3/4075 347/101 |
| 2005/0150508 | A1 * | 7/2005 | Downs | A45D 29/001 132/73 |
| 2009/0092310 | A1 | 4/2009 | Gifford | |
| 2013/0242019 | A1 | 9/2013 | Bitoh | |
| 2013/0247929 | A1 | 9/2013 | Namai | |
| 2013/0319444 | A1 | 12/2013 | Pak | |

* cited by examiner

*Primary Examiner* — Rachel Steitz
(74) *Attorney, Agent, or Firm* — Jonathan D. Ball; Greenberg Traurig, LLP

(57) ABSTRACT

The invention relates generally to nail strips that may be adhered to human finger and toe nails. The strips are provided in the form of a sheet having a plurality of cutout strips in the general shape of a nail which may be peeled from the sheet. The nail strips may be decorated by printing user-created or selected designs using a home printer. The size and/or shape of the nail strips may be adjusted by selecting and detaching an appropriate perforated edge from the sheet backing.

5 Claims, 5 Drawing Sheets

PRINTABLE NAIL STRIPS

CROSS-REFERENCE TO RELATED APPLICATIONS

This patent application claims priority to U.S. Patent Application Ser. No. 61/919,271 filed on Dec. 20, 2013. The entirety of the aforementioned application is incorporated herein in its entirety by reference.

FIELD OF INVENTION

The invention relates generally to nail strips that may be adhered to human finger and toe nails. The strips are provided in the form of a sheet having a plurality of cutout strips in the general shape of a nail which may be peeled from the sheet. The nail strips may be decorated by printing user-created or selected designs using a home printer.

BACKGROUND

The foregoing discussion is presented solely to provide a better understanding of nature of the problems confronting the art and should not be construed in any way as an admission as to prior art nor should the citation of any reference herein be construed as an admission that such reference constitutes "prior art" to the instant application.

When fingernails or toenails are coated with liquid nail polish, the liquid polish is dried by exposure to the air. While the polish on the nail is left to dry, the nails must not come into contact with any object, or else the nail coat becomes smudged or smeared. The problem of waiting for the polish to dry is accentuated for manicuring or pedicuring with ornamental design because the treatment typically requires at least two steps. A first coat of liquid nail polish is applied to the nails and must dry before the application of any design elements. Likewise, in the case of applying a design via a liquid nail polish, the design elements must also dry before the nail can be used. Such nail treatment clearly requires a great deal of time for the necessary drying.

These problems have been somewhat dissipated by the use of a semi-solid form, or finger strip, nail coat techniques. A finger enamel layer that can be adhesively secured to the nail substantially reduces the time involved to coat or polish the nail. Further, this technique eliminates the accidental contact between the liquefied nail polish and the user's skin.

Nail enamel strips are known in which a pliable nail enamel film is peelably or detachably provided on a substrate. The human nail-shaped pliable nail enamel film has an adhesive layer and one or more nail enamel layers, for example, a top coat layer and a base coat layer. Each enamel layer may have different ingredients depending where the layer is positioned, such as a top layer or a base layer. Other such films have a single nail enamel layer. These nail enamel strips are sealed in an airtight envelope or package to maintain the pliability of the nail enamel film. The package is opened when it is desired to use the product. The nail enamel film is peeled from the substrate and then placed by the user onto a nail. The nail enamel film is sufficiently pliable that it can conform to the contours of a user's nail. After application of the nail enamel film to the user's nail, the nail enamel film is allowed to dry in air to allow residual solvent to evaporate.

Self-adhesive nail enamel strips for fingernails and toenails are also known that have a cross-linked nail enamel layer to provide long-lasting wear and a shiny appearance, without the need of ultraviolet (UV) light curing and, thus, professional assistance. That is, the nail enamel strips include a layer that has a pre-cured, cross-linked polymer as disclosed in U.S. Pat. No. 8,586,164, the contents of which are hereby incorporated by reference.

The pre-packaged nail enamel strips typically come pre-designed on some form of a transfer sheet, wherein the user must select the design from the sheet and apply it to the fingernail or toenail. Although the pre-packaged nail enamel strips offer convenience and some flexibility to the user in terms of design selection, there exists a need for a fully customizable nail enamel strip. The present invention offers an opportunity for the user to create a design, in addition to selecting a design from a virtually limitless library, and to print the selected design onto a sheet of releasable nail enamel strips on a conventional home printer prior to application.

A nail print apparatus, as disclosed in U.S. Publications No. 2013/0247929 and 2013/0242019, the contents of which are hereby incorporated by reference, is also known in the art. A print head prints a nail design directly onto a nail of a finger inserted into the apparatus. Such an apparatus is not suited for home use. The advantages of the present invention include, but are not limited to, the ability to completely customize and design images at the user's convenience (e.g., without traveling to a nail salon) and print the images using a conventional home printer.

WIPO Publication No. WO2000/010149, the contents of which are hereby incorporated by reference, discloses a computer game in which a hand with fingernails is displayed on the computer screen and a user selects a color and/or design from selectable icons to apply to the fingernails. The user then has the option of printing the nail images upon a laminated sheet containing a plurality of nail color cutouts. That publication is limited in the applicability of the system at least because it is a children's game and there is no recognition of user-created fully customizable nail strips. The WO2000/010149 publication does not describe strips of multiple sizes or any system for printing on nail strips of varying size.

Moreover, because nail size varies from person to person, it is impossible to design a single nail enamel strip that will universally or nearly universally fit every nail. To address this problem, conventional pre-packaged nail enamel strips are provided in a variety of sizes for each nail. The obvious problem with this approach is the increased expense involved and the larger packaging required for providing multiple nail strips for each fingernail. Accordingly, it would be desirable to provide a single sheet of printable nail strips that are adjustable in size, vertically and/or horizontally, to fit virtually any user. It would also be desirable to provide a computer-implemented system for printing on different size nail strips wherein software is configured to receive an identifier which uniquely identifies sheet of nail strips and instructs a home printer to adjust the print area depending on the size of the nail strip.

SUMMARY OF THE INVENTION

In accordance with the foregoing objectives and others, the present invention provides articles, methods, and systems for preparing nail strips having user-customized designs printed thereon. In one aspect of the invention, a sheet is provided for printing peelable nail enamels strips from a home printer. The sheet is flexible and suitably sized for use with a home printer (e.g., about 8.5 inches by 11 inches). The sheet comprises a backing layer which may be any flexible substrate suitably constructed and configured for use with a home printer (e.g., an inkjet printer), for example, a paper or plastic sheet. The backing layer may optionally have one or more finishing layers disposed thereon to modify the properties (e.g., tack, flexibility, solvent resistance, etc.) of the backing layer, or to prepare the substrate for application of the enamel layer. The backing layer may, for example, have deposited thereon a hydrophobic layer (e.g., polyolefin, wax, silicone or PTFE). The sheet further comprises an adhesive layer (e.g., a pressure sensitive adhesive) between the backing layer and the enamel for adhering the enameled strip to the nails. The flexible sheet further comprises one or more nail enamel layers, which may comprise, without limitation, nitrocellulose and/or other film forming polymers. The nitrocellulose and/or other film forming polymers may be UV or thermally cured to form cross-links. Any of the layers, including the nitrocellulose layer, may be transparent, translucent, or opaque and may comprise colorants, such as pigments and lakes. The sheet has a plurality of strips thereon defined by cuts or perforations such that they can be peeled from the sheet, the cutouts being configured in the general shape of a human fingernail or toenail. The peelable strips may include at least the nail enamel layer and an adhesive layer for securing the strip to the nails. The sheet may further comprise a removable masking film on top of the entire sheet or a portion thereof (e.g., on top of each of the nail strip cutouts), for protecting the enamel layer prior to use.

A user can create or select a design on a computer (e.g., a home computer, hand-held computer, tablet, smartphone, etc.) and print the design onto the sheet, typically using a home printer, such as an inkjet printer or laser printer. The design can be created using dedicated software running on the user's computer or device (e.g., installed from a computer-readable medium, for example, a CD, provided with the nail sheets or downloaded from the Internet) or running on a remote server and accessed on the user's computer or device over the Internet (e.g., a website). The software may provide a drawing canvas in the general shape corresponding to the shape of the peelable nail strips (e.g., a fingernail or toe nail) and drawing tools such as backgrounds, patterns, shapes, alphanumeric and other symbols, line-drawing tools, paint brushes, color-selection tools and the like. The user may also add photographic images, computer-generated images, clip art, or other digitized images to the drawing canvas. Images may be imported from the user's computer or other peripheral device in any suitable file format, including without limitation, bitmap (e.g., JPEG, TIFF, GIF, etc.) or vector graphics (e.g., EPS, WMS, SVG, etc.) formats. Digitized images, such as photographs and clip art may be provided as part of the software or maybe imported over the Internet or uploaded from a user's computer or device (e.g., a smart phone or camera), and can be placed into the drawing canvas, either as the sole design or in combination with other user-created or user-defined designs. The software includes instructions for printing the image onto one or more of the peelable nail enamels strips on the sheet. The inkjet printer may be equipped with color ink cartridges for printing colored designs. The inks may comprise specialty pigments such as glitters, goniometric pigments, interferences pigments, pearlescent pigments, and the like, and may be pigments inks and/or dyes inks.

In some implementations, the user may select, using the computer, which among the plurality of peelable nail enamels strips on the sheet is to be printed on. For example, a sheet may be provided with several rows and columns of peelable nail strips, but the user may instruct that only a single row or only a single column (or a designated number of rows or columns) are to be printed. Similarly, the user may designate a single peelable nail strip from among all of the peelable nail strips on the sheet to be printed. In one implementation, the user may prepare a plurality of designs using the software and may print different designs on different peelable nail strips. For example, a user might create a plurality of different designs comprising alphanumeric symbols that collectively spell a word or phrase and print the plurality of designs simultaneously across a row of peelable nail strips (e.g., corresponding to the each of the fingers of a hand). Similarly, different photographic images can be printed onto different peelable nail strips using a single print command.

In another aspect, a printable sheet of the invention having the features described above is provided wherein at least two of the plurality of nail-shaped peelable strips are of different sizes. The sheet may have at least one peelable strip of relatively larger size, for example, configured to approximate the shape and size of a human thumbnail, and at least one peelable strip of relatively smaller size, for example, configured to approximate the size of at least one human finger nail. The software is configured to provide instructions for automatically adjusting the printed image size to match the print area of each of the various peelable nails strips on the sheet. In other embodiments, two or more sheets may be provided that differ in the relative size of the nails. For example, one sheet may have nail strips sized for larger nails and another sheet may have nail strips sized for smaller nails. Each of the sheets may include an identifier, such as a number, that may be entered or selected by the user of the software before printing which configures the computer to adjust the print area so that the printer prints the design in the proper location and in proportion to the nail strip size. Similarly, because peelable strips for fingernails may differ in size from peelable strips for toenails the respective sheets may contain different identifiers which can be used to instruct the computer to adjust the image to correspond to the print area of each nail strip. In one embodiment of the invention, a package of sheets comprising peelable nail strips is provided wherein at least two of the sheets differ with respect to the size, shape, or position of at least one peelable nail strip and wherein each of the differing sheets bears an identifier for instructing a computer to print a design corresponding in size and shape to the peelable area of the sheet.

In another embodiment, a printable sheet is provided having at least one peelable nail strip thereon defined by a first nail-shaped cutout portion of the enamel layer. Additional perforations or cuts are made in the enamel layer around the first cutout to define longer and/or wider strips than the first cutout portion such that the user may selectively peel a portion of the strip comprising the first cutout portion together with any adjacent portion defined by said additional perforations or cuts corresponding to the desired length and/or width of the nail. Use of such perforations may, in one embodiment, substantially decrease the likelihood for and/or extent of post-application enamel layer trimming. In one embodiment, additional perforations or cuts in the enamel layer are provided corresponding to a plurality of different nail lengths such that the nail strip may be peeled from the backing sheet along with a selected additional length defined by additional perforations or cuts in the enamel. The user may input instructions to the computer identifying the desired length of the nail strips so that the computer scales the design canvas and/or instructs the printer to print in the area to correspond to the selected length of the nail strip and/or the number of selectable perforated portions of the perforated nail strip desired.

In an embodiment of the invention, a 3D printer and/or a 3D mill can be used to create nails strips having textures or other 3-dimensional effects. The computer software is configured to permit a user to design 3D patterns and/or shapes and/or images. The 3D printer may operate using different color plastics to create multi-color nail effects in addition to the 3-dimensional patterns and/or shapes and/or images. In the case of a 3D mill, plastic blanks may be provided for milling which can generally be in the form of elongate plastic strips or bricks. In one embodiment the mill is capable of creating nail strips customized to the size of a user's fingernails. The software may be configured to operate the mill so as to customize the shape of the nail strip to exactly match the user's nail or a portion thereof. In one embodiment the plastic blanks are comprised of nitrocellulose. The plastic blanks may be provided in an assortment of colors.

These and other aspects of the present invention will become apparent to those skilled in the art after a reading of the following detailed description of the invention, including the appended claims.

DETAILED DESCRIPTION

All terms used herein are intended to have their ordinary meaning unless otherwise provided. Layer thicknesses are provided in mils, or 1/1000 of an inch, unless otherwise indicated.

Figure 1A:
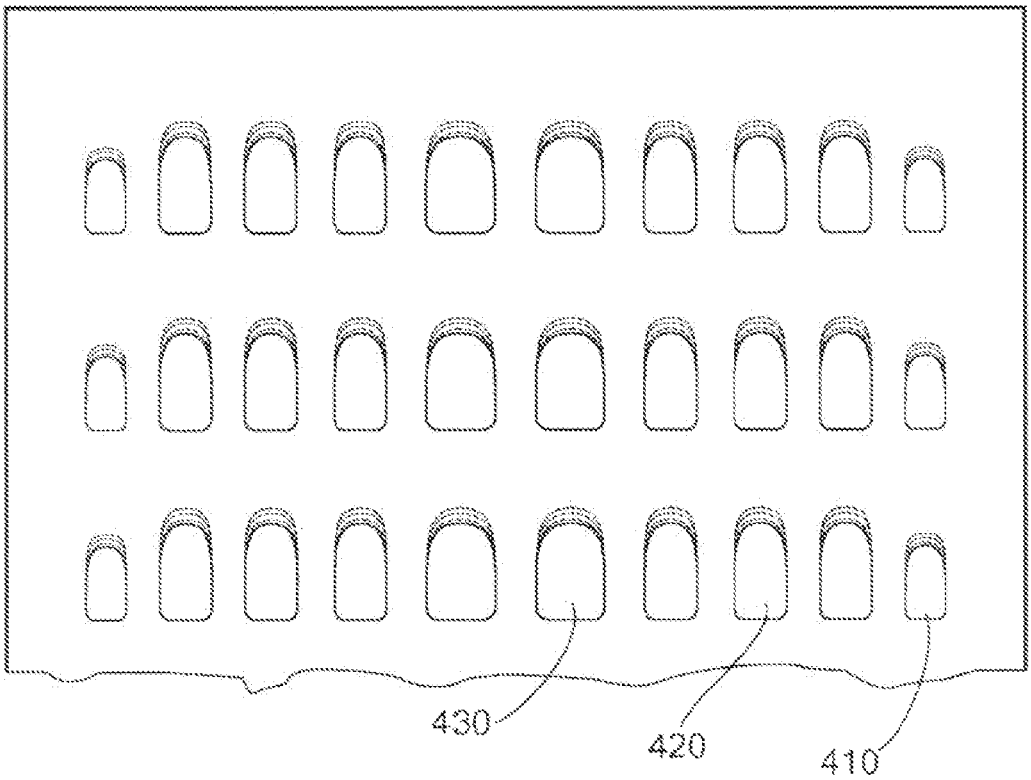
FIG. 1A shows a printable sheet comprising a plurality of nail enamel strips according to an embodiment of the present invention. As illustrated, according to this embodiment the sheet comprises different size nail strips including large nail strips 430, medium nail strips 420, and small nail strips 410.

FIG. 1 shows one embodiment of a printable sheet according to the invention. The sheet contains a plurality of releasable printable nail enamel strips. The sheet has one or more layers of nail enamel film capable of being peelably detached from one or more backing layers. The nail enamel strips may vary in size so as to fit the user's fingers of different sizes. The nail enamel strips are generally configured to the size of an adult female's nails. In one embodiment, the sheet may have at least one peelable strip of relatively larger size, for example, configured to approximate the shape and size of a human thumbnail, and at least one peelable strip of relatively smaller size, for example, configured to approximate the size of at least one human finger nail. For example, nails strips 410, 420 and 430 may correspond, respectively, to the size of a pinky, middle three fingers, and thumb. The nail enamel strips may further have one or more additional perforations for adjusting the size of the nail strip to be applied.

The sheet typically comprises (in order) a backing layer, an optional release layer, an optional adhesive layer and a nail enamel film. The nail enamel film comprises one or more nail enamel layers. The sheet is flexible and suitably sized for use with a home printer (e.g., about 8.5 inches by 11 inches).

Figure 5:
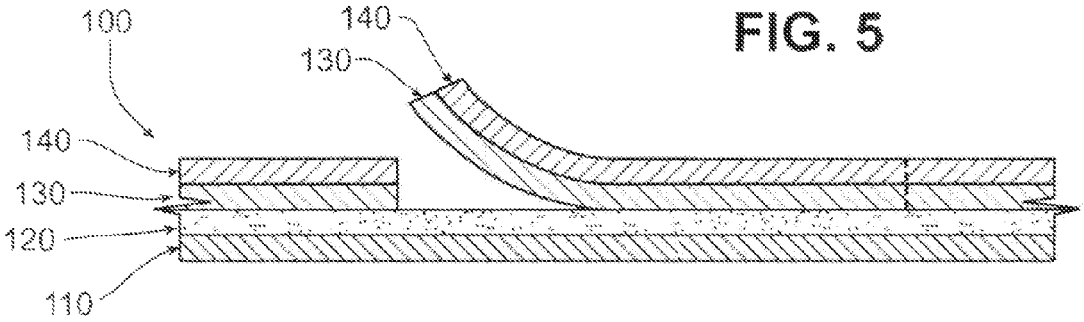
FIG. 5 is a cross sectional view of one embodiment of a printable sheet according to the invention demonstrating a nail enamel strip peelably detaching from the substrate. As illustrated, the sheet according to this embodiment comprises a backing layer 110, a release layer 120, an adhesive layer 130, and a nail enamel layer 140.

A cross-section of a sheet according to one embodiment of the present invention is shown in FIG. 5. The backing or substrate layer 110 is typically a paper or other cellulosic material. The backing layer can also be plastic or a laminate. The backing layer is typically of conventional dimensions and flexibility for use in a home printer (such as an inkjet printer). The thickness of the substrate layer may, for example, range from about 1 to about 100 mil, more typically from about 2 to about 30 mil, or from about 3 to about 10 mil.

The backing layer may, for example, have deposited thereon a hydrophobic layer (e.g., polyolefin, silicone, wax, or PTFE). This layer 120 may be composed of any suitable material for facilitating release of the enamel layer from the sheet. In one embodiment, the backing layer is coated on one of its two sides with a silicone-based or silicone-free release coating. The purpose of the release coating 120 is to provide an easier release for the nail enamel film. Suitable coatings can include water-based and solvent-based conventional dehesive systems. The thickness of the release layer typically ranges from about 0.1 to about 10 mil, more typically from about 0.2 to about 2 mil, most typically from about 0.5 to about 1.5 mil.

An adhesive layer or coating 130 may be deposited on top of the release coating 120 or, in the absence of optional layer 120, directly on the backing layer 110. The adhesive layer may substantially remain on the substrate and permit the nail enamel film to be easily peelable from the substrate 110 or release coating 120, in which case there may be sufficient residual adhesive on the bottom surface of the nail enamel strip 140 to allow it to adhere to the nail. Alternatively, the adhesive coating 130 can be peeled along with the nail enamel strip 140, as shown in FIG. 5, and used to adhere the nail enamel strip to the nail.

The adhesive layer 130 assists in having the nail film, namely the nail enamel layers, remain on the nail strip sheet prior to use and/or in securing the nail film to the user's nail. The adhesive of the adhesive layer can be, without limitation, any water-based or solvent-based adhesive that is not harmful to skin. In one embodiment, the adhesive comprises a pressure-sensitive adhesive.

Acrylic copolymers are contemplated to be suitable. The thickness of the adhesive layer can range from about 0.1 to about 10 mil, typically from about 0.2 to about 5 mil, most typically from about 0.5 to about 1 mil.

One or more nail enamel film layers 140 is deposited on top of the optimal adhesive layer 130 or on top of the optimal release layer 120, or directly on backing layer 110. The nail enamel film layer 140 may comprise any conventional material known in the art for use in nail enamels. These materials include, without limitation, cross-linkable polymer materials, e.g., polymers that can be cross-linked by curing using UV light or thermal energy. The term "cross-linkable polymer" is inclusive of cross-linkable polymers that have been cross-linked. The nail enamel film 140 may have in any layer, preferably the nail enamel layer having the cross-linked polymer, one or more plasticizers, one or more adjuvant film-forming polymers, one or more thickeners or leveling agents, and one or more optional ingredients. In addition, the nail enamel films may have a residual amount of solvent that is not evaporated from the nail enamel layer during the manufacturing process. This residual solvent may ensure that each of the nail enamel layers, and hence of the nail enamel film itself, will have sufficient pliability so that the nail enamel film can be peeled from the substrate and placed by the user on a nail. In one embodiment, the nail enamel layer may have one or more pigments, lakes, pearls, glitters, or other colorants (e.g. dyes) to provide color and/or aesthetic effects. Each nail enamel layer may have other optional ingredients. These ingredients include one or more thickeners or leveling agents, pearlescent agents, or glitters to give the desired effects.

The nail enamel film 140 may have a composite thickness in the range of about 0.5 mil to about 100 mil, more typically from about 0.5 mil to about 50 mil, still more typically from about 0.5 mil to about 20 mil, or about 1 mil to about 5 mil. Each nail enamel layer may have a thickness in the range from about 0.1 mil to about 50 mil, or from about 1 mil to about 20 mil, or from about 1 to about 5 mil. Especially for multilayer nail enamel films, the nail enamel layer may have a thickness in the range from about 1 mil to about 5 mil, although thicker and thinner enamel layers are within the scope of the invention.

Any of the layers, including the nail enamel layer, may be transparent, translucent, or opaque and may comprise colorants, such as pigments and lakes. The sheet may further comprise a removable masking film (not shown) on top of the entire sheet or a portion thereof (e.g., on top of each of the nail strip cutouts), for protecting the enamel layer prior to use. The masking film may be a cellulosic, such as a tissue, or a clear sheet of thin plastic, or the like.

The sheet of the present invention is adapted for being inserted into a printer for printing a user-selected design directly on the nail enamel film. The sheet of the present invention can be used with any conventional home printer. The printer may be, for example, an inkjet or a laser printer, thermal wax printer, solid ink printer capable of printing color and/or black and white images. Many additional computer printers also may be used, including commercial printers and non-printer devices such as photocopiers.

In an embodiment of the invention, a 3D printer and/or a 3D mill can be used to create nails strips having textures or other three-dimensional effects. The computer software may be configured to permit a user to design three-dimensional patterns and/or shapes and/or images. For example, a user may upload a photograph of an individual's face into the software, and the software would then convert the image into a 3-dimensional rendition of the face which would then be printed using a 3D printer or milled using a 3D mill.

In one embodiment a 3D printer may operate using different color plastics to create multi-color nail effects in addition to the 3-dimensional patterns and/or shapes and/or images. In the case of a 3D mill, plastic blanks may be provided for milling which can generally be in the form of elongate plastic strips. In one embodiment the plastic blanks are comprised of nitrocellulose. The plastic blanks may further be provided in an assortment of colors. In one embodiment the mill is capable of creating nail strips customized to the size of a user's fingernails. The user may, for example, input measurements of each fingernail, or may upload a digitized photo of a fingernail and the software may extract the exact dimensions of each fingernail using known algorithms. The software may be configured to operate a 3D mill so as to customize the shape of the nail strip to exactly match that to a user's nail or a portion thereof.

Figure 3:
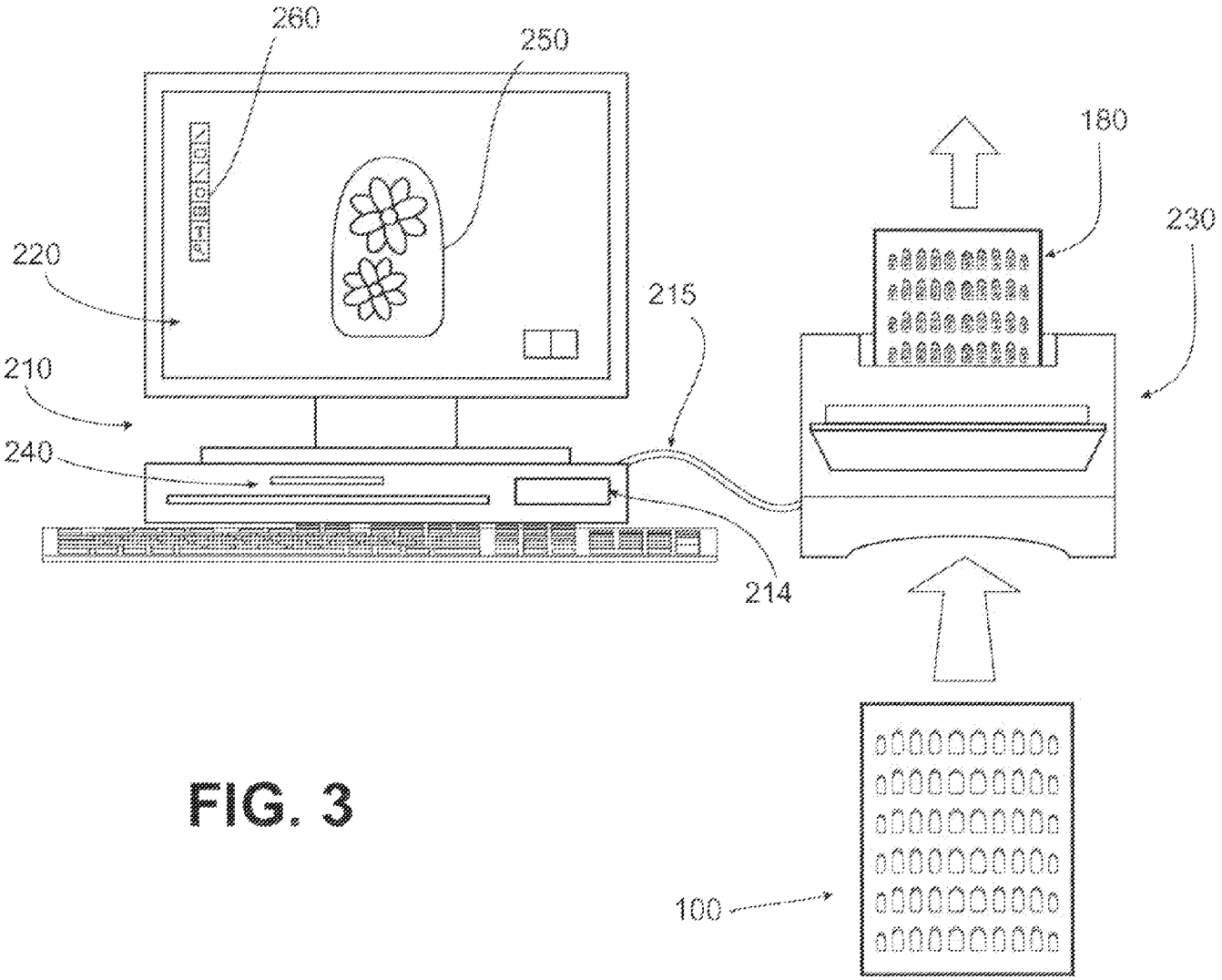
FIG. 3 illustrates one embodiment of a computer system used to design and/or select and print an image onto the enamel layer of a nail strip. In this embodiment the computer system 210 comprises a monitor 220, and a printer 230 connected to the computer system 210 via a cable 215. The computer system 210 also comprises a removable media reader 240 and an input port 214. The screen 220 of the computer system 210 displays one embodiment of a drawing canvas 250 and drawing tools 260. As illustrated, a sheet of nail strips 100 according to one embodiment is fed into the printer 230, and a sheet of printed nail strips 180 is produced by the printer 230 wherein the printing occurs substantially only within the nail strips.

A schematic view of a computer system in operation according to a method of the present invention is shown in FIG. 3. A computer 210 has a screen 220 and a connected printer 230. The computer is displaying a screenshot of an illustrative nail design software. A printable nail strip sheet 100 is fed into printer 230, and a printed nail strip sheet 180 containing one or multiple user designs is produced by the printer. The individual nail strips may then be applied to the user's fingernails or toenails.

A computer 210 operating in accordance with an embodiment of the present invention may be operably connected to a printer 230 to transfer print data. In one embodiment, computer system 210 may be operably connected to printer 230 via a direct cable 215. In another embodiment, a computer system 210 may be operably connected to printer 230 via a wireless connection. In another embodiment, a computer system 210 may be operably connected to printer 230 via a local area network or a wide area network such as the Internet. Printer 230 may be operably connected to multiple computers concurrently. In another embodiment, a computer system 210 and screen 220 may be embedded within printer 230.

A computer 210 includes a processor and an information storage device. Computer 210 may further include a removable media reader 240. Computer 210 may further include an input port 214 such as a USB or lightning port for connecting devices, removable storage media and removable media readers. Computer 210 may further include a network connection. Computer 210 may be loaded with software, images and data residing in storage device or accessible through removable media reader 240, network connection or a device connected to input port 214. The term "computer" is intended to include lap top computers, tablet computers (e.g., iPad), smart phones, and other devices containing a processor and storage device, unless otherwise indicated.

A user can create or select a design on computer 210 (e.g., a home computer, hand-held computer, tablet, smartphone, etc.) and print the design onto the sheet, typically using a home printer, such as an inkjet printer or laser printer. The design can be created using dedicated software running on the user's computer or device (e.g., installed from a CD provided with the nail sheets or downloaded from the Internet) or running on a remote server and accessed on the user's computer or device over the Internet (e.g., a website).

The software may provide a drawing canvas 250 in the general shape corresponding to the shape of the peelable nail strips (e.g., a fingernail or toe nail) and drawing tools 260 such as backgrounds, patterns, shapes, alphanumeric and other symbols, line-drawing tools, paint brushes, color-selection tools and the like. The user may also add photographic images, computer-generated images, clip art, or other digitized images to the drawing canvas. Images may be imported from the user's computer or other peripheral device (e.g., digital camera, smart phone, etc.) in any suitable file format, including without limitation, bitmap (e.g., JPEG, TIFF, GIF, etc.) or vector graphics (e.g., EPS, WMS, SVG, etc.) formats. Digitized images, such as photographs and clip art may be provided as part of the software or maybe imported over Internet or uploaded from a user's computer or device (e.g., a smart phone or camera), and can be placed into the drawing canvas, either as the sole design or in combination with other user-created or user-defined designs. The software may enable the image to be scaled or resized. The software includes instructions for printing the image onto one or more of the peelable nail enamels strips on the sheet.

In one embodiment, the software loaded on computer 210 contains a template that includes information about the characteristics of the nail strips on a given sheet. Each template includes at least information as to the location and size of each nail strip on a given sheet. Each template is preferably identified with an identifier, which may comprise a particular series of letters, numbers and/or symbols. A sheet may include a plurality of sizes of nail strips to accommodate the differences in sizes between a given person's fingers and toes. Each of the sheets may include an identifier, such as a series of numbers, letters, and/or symbols that may be entered or selected by the user of the software before printing. The identifier may configure the computer to select a template that would accordingly adjust the print area so that the printer prints the design in the proper location and in proportion to the nail strip size. Similarly, because peelable strips for fingernails may differ in size from peelable strips for toenails the respective sheets may contain different identifiers which can be used to instruct the computer to adjust the image to correspond to the print area of each nail strip. In one embodiment of the invention, sheets of peelable nail strips are provided wherein at least two of the sheets differ with respect to the size, shape, or position of at least one peelable nail strip and wherein each of the differing sheets bears an identifier for instructing a computer to print a design corresponding in size and shape to the peelable area of the sheet. The sheets may be packaged together or may be provided separately based on the needs of the customer.

The sheet of the present invention may be printed with ink to form user-selected images positioned on the cutout nail enamel strips. Suitable inks can include any type of ink, preferably ones that are not harmful or toxic when applied to a human integument. Types of ink can include without limitation inkjet printer inks, solid inks, Drop-On-Demand (DOD) inks & high resolution inks. Inks may include, without limitation, pigmented oil-based, solvent based, water-based, dye-sublimation & UV-curable inks. In an embodiment of the present invention, FDA-approved inks, such as inks approved for food contact and pharmaceutical products, can be used. In another embodiment, special effects inks can be used, such as, but not limited to, glitter inks, shimmer inks, pearlescent inks, fluorescent inks, glow in the dark inks, and metallic inks. In one embodiment, special effects inks can be plastisol inks conventionally used for screen printing.

Figure 1B:
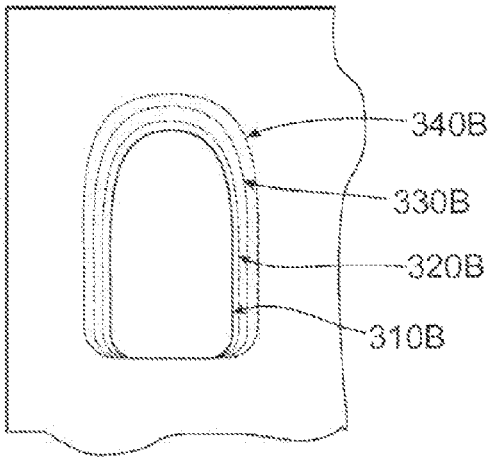
FIG. 1B shows a portion of a printable sheet comprising a nail enamel strip according to another embodiment of the present invention. In the embodiment, the nail enamel strip is defined by a cutout indicated by numeral 310B, and a series of perforations for adjusting the size are indicated by numerals 320B, 330B, and 340B. In the embodiment of FIG. 1B the differently sized regions share a common boundary corresponding to the base (e.g, cuticle) region of the nail.
Figure 1C:
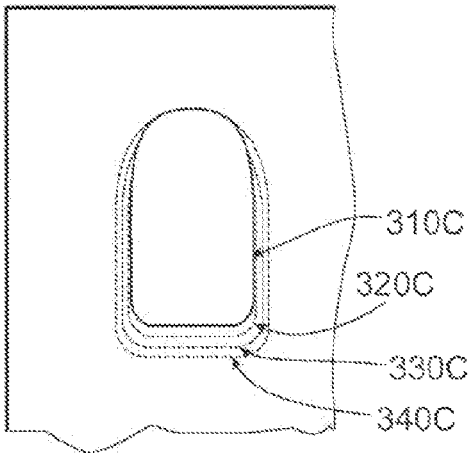
FIG. 1C shows a portion of a printable sheet comprising a nail enamel strip according to yet another embodiment of the present invention. In this embodiment, he nail enamel strip is defined by a cutout indicated by numeral 310C, and a series of perforations for adjusting the size are indicated by numerals 320C, 330C, and 340C. In the embodiment of FIG. 1C, the differently sized regions share a common boundary corresponding to the tip of the nail.
Figure 2:
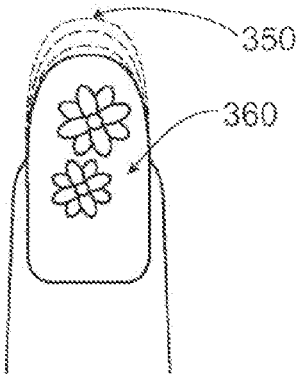
FIG. 2 is an enlarged view of a single nail enamel strip being applied to a user's fingernail. In this embodiment, the nail enamel strip is defined by a cutout indicated by numeral 360, and a series of perforations for adjusting the size lengthwise are indicated by numeral 350.

In some embodiments, series of perforations or cuts are made in the nail enamel layer so that the final size of the nail-shaped cutout strip can be adjusted by the user in both vertical and horizontal direction as shown in FIG. 1B, FIG. 1C and FIG. 2. The perforations or cuts provide for easy removal of the nail enamel strip from the sheet with adjustable sizes. In one embodiment, a constant width of the nail enamel strip is defined by a single perforation or cut 310. In some other embodiments, as shown in FIG. 1B and FIG. 1C, multiple perforations or cuts (e.g., one, two, or three additional perforations or cuts) are provided around the entire shape of the nail enamel strip. Additional perforations or cuts 320B, 330B, 340B and 320C, 330C and/or 340C may be made in the enamel layer around the cutout to define longer and/or wider strips than the first cutout portion 310B or 310C such that the user may selectively peel a portion of the strip comprising the first cutout portion 310B or 310C together with any adjacent portion defined by the additional perforations or cuts, such as 320B, 330B, 340B and 320C, 330C and/or 340C, corresponding to the desired length and/or width of the nail. In one embodiment, as shown in FIG. 2, additional perforations or cuts in the enamel layer are provided corresponding to a plurality of different nail lengths 350 such that the nail strip 360 may be peeled from the backing sheet along with a selected additional length defined by additional perforations or cuts in the enamel.

In one embodiment, the perforations or cuts are effected onto a sheet containing the substrate, adhesive, and nail enamel layers in such a way that only the nail enamel layer and optimally the adhesive layer is perforated or cut. The perforations or cuts can be accomplished by any convention method and device, including punches and the like.

The user may input instructions to the computer identifying the desired length of the nail strips so that the computer scales the design canvas and/or instructs the printer to print in the area to correspond to the selected length of the nail strip.

In some implementations, the user may select, using the computer, which among the plurality of peelable nail enamels strips on the sheet is to be printed on. For example, a sheet may be provided with several rows and columns of peelable nail strips, but the user may instruct that only a single row or only a single column (or a designated number of rows or columns) are to be printed. Similarly, the user may designate a single peelable nail strip from among all of the peelable nail strips on the sheet to be printed. A masking layer may be provided over the entire sheet and selectively removed in the area of the nail to be printed in order to protect the enamel surface of the strips that are not printed on. For example, a mask may be perforated so that portions of it may be selectively removed. A plurality of masks covering one or more selected strips may also be employed.

Figure 6:
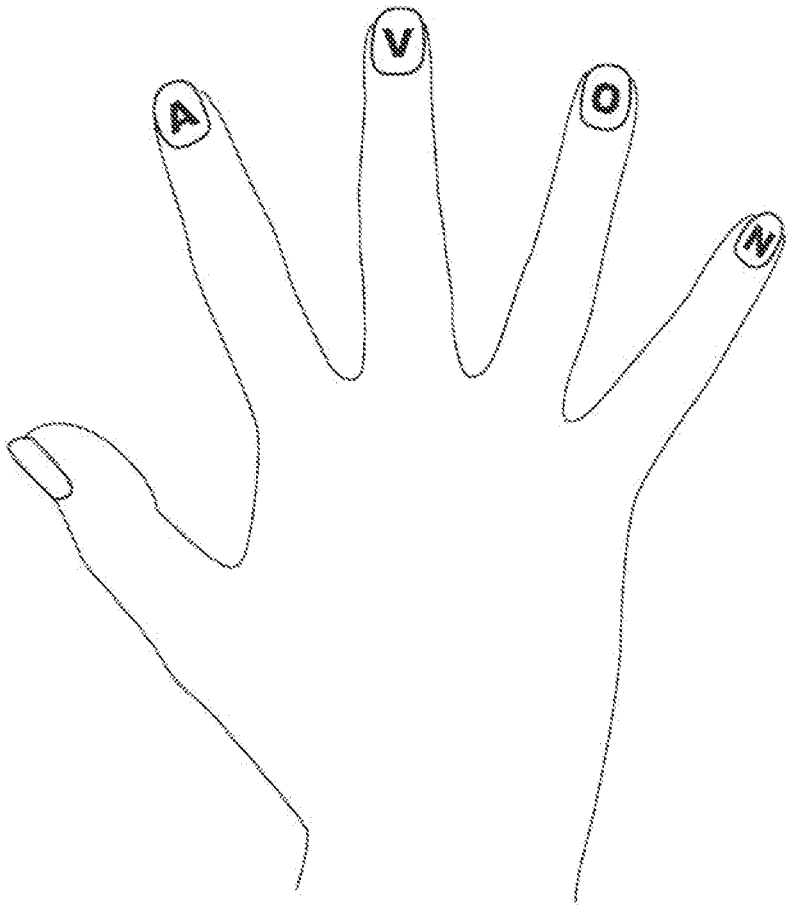
FIG. 6 depicts a user's hand with fingernails adorned with alphanumeric symbols according to an embodiment of the present invention. In this embodiment, a plurality of images may be created by the user and stored by the computer or stored on a computer-readable medium and subsequently printed simultaneously, e.g., across a row of nail strips, as shown in FIG. 1A.

In one implementation, the user may prepare a plurality of designs using the software and the software may be configured to store and index the plurality of images. The software may be configured to print the different designs on different peelable nail strips according to the indices. For example, a user might create a plurality of different designs comprising alphanumeric symbols that collectively spell a word or phrase and print the plurality of designs simultaneously across a row of peelable nail strips (e.g., corresponding to the each of the fingers of a hand), as shown in FIG. 6. Similarly, different photographic images can be printed onto different peelable nail strips using a single print command.

Figure 4:
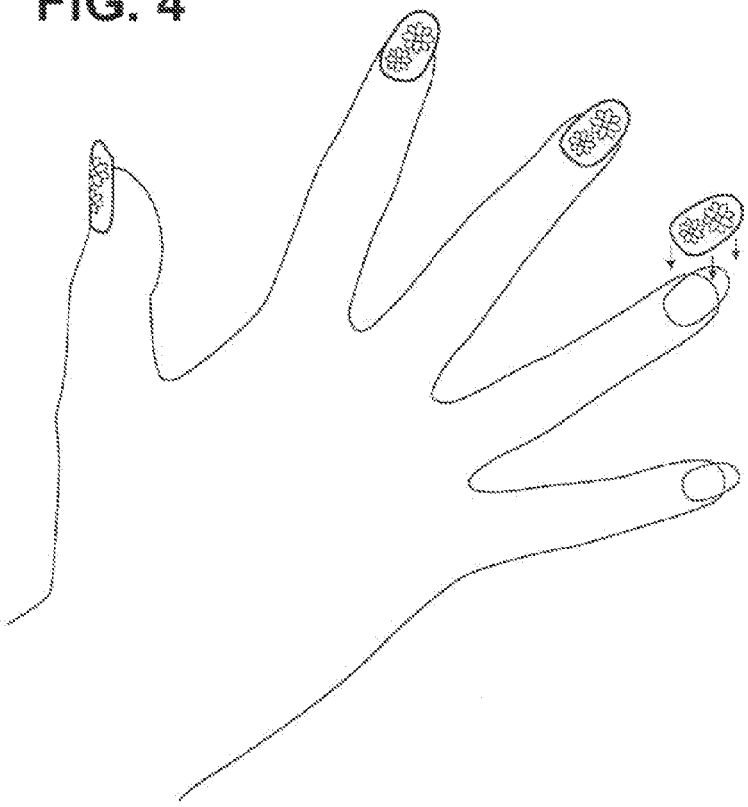
FIG. 4 depicts a user's hand in the process of applying printed nail enamel strips.

During application, the user removes a printed nail enamel film from the substrate of the sheet containing the plurality of the nail enamel strips. The user optimally utilizes the perforation (if included on the nail sheet) for easy removal while simultaneously customizing the size of the nail enamel film by selecting the appropriate perforation. Alternatively, the user may remove the printed nail enamel film along the outermost perforation first, e.g. 340B or 340C in FIG. 2, and subsequently trim the film along a smaller perforation, e.g. 320B, 320C, 330B or 330C, to correspond to the nail shape. Then, the nail enamel film may be secured to the nail by pressing the nail enamel film firmly onto the nail, as shown in FIG. 4. FIG. 4 depicts a user's hand with two nail enamel strips already positioned and a third being applied by pressing the nail strip down on the nail.

In one embodiment, the nail can optionally be coated with a base coat prior to the application of the printed nail enamel strip. The base coat may, for example, improve adhesion of the nail enamel to the nail. The base coat may also be colored or otherwise decorated. In another embodiment, the nail can optionally be coated with an adhesive in addition to or instead of the base coat, prior to the application of the printed nail enamel strip, to achieve durable placement of the nail enamel film onto the nail. In yet another embodiment, the nail enamel film is optionally coated with a transparent top coat subsequent to the attachment of the strip to the nail.

The invention described and claimed herein is not to be limited in scope by the specific embodiments herein disclosed since these embodiments are intended as illustrations of several aspects of the invention. Any equivalent embodiments are intended to be within the scope of this invention. Indeed, various modifications of the invention in addition to those shown and described therein will become apparent to those skilled in the art from the foregoing description. Such modifications are also intended to fall within the scope of the appended claims. All publications cited herein are incorporated by reference in their entirety.

What is claimed:

1. A package comprising:

at least one sheet comprising a plurality of peelable cutout strips in the shape of a human nail, at least one of the cutout strips being different in size and/or shape than at least one other cutout strip, wherein the final size of at least one of said plurality of cutout strips can be adjusted in both vertical and horizontal directions with approximately concentric perforated edges;

each of said at least one sheets having an identifier for instructing a computer to print the image on a home printer within the area of the peelable cutout strips.

2. The package according to claim 1, wherein the package further comprises written instructions for accessing software used for creating and/or manipulating said images.

3. The package according to claim 2, wherein the instructions identify a web address for accessing software used for creating images.

4. The package according to claim 2, wherein the package further comprises a computer-readable storage medium including software used for creating and/or manipulating images, and written instructions for using said computer-readable storage medium.

5. The package of claim 1, comprising a plurality of sheets of peelable cutout strips, at least one sheet having peelable cutout strips of different size and/or shape than the peelable strips of at least one other sheet.

* * * * *